US011566475B2

(12) United States Patent
Portwood et al.

(10) Patent No.: US 11,566,475 B2
(45) Date of Patent: Jan. 31, 2023

(54) FIXED CUTTER DRILL BIT WITH HIGH FLUID PRESSURES

(71) Applicant: Smith International, Inc., Houston, TX (US)

(72) Inventors: Gary R. Portwood, Saline di Volterra (IT); Simone Pallesi, Saline di Volterra (IT); Alessio Cechi, Saline di Volterra (IT); Alessandro Bertini, Saline di Volterra (IT)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/258,512

(22) PCT Filed: Jul. 5, 2019

(86) PCT No.: PCT/US2019/040674
§ 371 (c)(1),
(2) Date: Jan. 7, 2021

(87) PCT Pub. No.: WO2020/014082
PCT Pub. Date: Jan. 16, 2020

(65) Prior Publication Data

US 2021/0277721 A1 Sep. 9, 2021

Related U.S. Application Data

(60) Provisional application No. 62/694,972, filed on Jul. 7, 2018.

(51) Int. Cl.
*E21B 10/18* (2006.01)
*E21B 7/18* (2006.01)
(Continued)

(52) U.S. Cl.
CPC ..... *E21B 10/18* (2013.01); *E21B 7/18* (2013.01); *E21B 10/61* (2013.01); *E21B 17/18* (2013.01)

(58) Field of Classification Search
CPC . E21B 10/18; E21B 7/18; E21B 10/61; E21B 17/18
See application file for complete search history.

(56) References Cited

U.S. PATENT DOCUMENTS 4,185,706 A 1/1980 Baker, III et al.
5,601,153 A 2/1997 Ensminger et al.
(Continued)

FOREIGN PATENT DOCUMENTS

CN 202706914 A 1/2013
CN 106194029 A 12/2016
(Continued)

OTHER PUBLICATIONS

International Preliminary Report on Patentability issued in International Patent application PCT/US2019040674 dated Jan. 21, 2021, 10 pages.
(Continued)

*Primary Examiner* — Yong-Suk (Philip) Ro

(57) ABSTRACT

A drill bit includes a bit body with high and low fluid pressure bodies. The low-pressure bit body includes a fixed cutting structure, and the high-pressure bit body includes at least one high-pressure fluid channel and nozzle capable of withstanding fluid pressures greater than 40 kpsi (276 MPa). A bottomhole assembly includes a drill bit with a bit body having fixed cutter and fluid jetting portions. Low and high-pressure channels in the bit body exit in the fixed cutter and fluid jetting portions. A high-pressure nozzle is coupled to the fluid jetting portion and the high-pressure fluid channel, and a plurality of fixed cutting elements are coupled to the fixed cutter portion. A pressure intensifier is coupled
(Continued)

to the drill bit and is configured to increase a pressure of a fluid supplied to the high-pressure fluid channel in the bit body.

20 Claims, 8 Drawing Sheets

(51) Int. Cl.
*E21B 10/61* (2006.01)
*E21B 17/18* (2006.01)

(56) References Cited

U.S. PATENT DOCUMENTS

| | | | |
|---|---|---|---|
| 5,787,998 | A | 8/1998 | OHanlon et al. |
| 5,862,871 | A | 1/1999 | Curlett |
| 6,289,998 | B1 | 9/2001 | Krueger et al. |
| 8,544,567 | B2 | 10/2013 | Comeau et al. |
| 8,827,009 | B1 | 9/2014 | Rankin, III |
| 2005/0189148 | A1 | 9/2005 | Larsen et al. |
| 2005/0217899 | A1 | 10/2005 | Hossain et al. |
| 2007/0125580 | A1 | 6/2007 | Hall et al. |
| 2013/0199849 | A1 | 8/2013 | Li et al. |
| 2014/0116783 | A1 | 5/2014 | Villareal et al. |
| 2018/0112469 | A1 | 4/2018 | Ghaziani |
| 2020/0014082 | A1 | 1/2020 | Srinivasan et al. |
| 2021/0140245 | A1 | 5/2021 | Portwood et al. |

FOREIGN PATENT DOCUMENTS

| | | |
|---|---|---|
| CN | 201265360 | 12/2016 |
| WO | 2018121815 A1 | 7/2018 |

OTHER PUBLICATIONS

International Search Report and Written Opinion issued in International Patent application PCT/US2019/033035 dated Aug. 29, 2019, 12 pages.
International Search Report and Written Opinion issued in International Patent application PCT/US2019040674 dated Oct. 23, 2019, 14 pages.
SITEC-Sieber Engineering AG, Fittings Catalogue 720.00, pp. 41-43 downloaded from https://www.sitec-hp.ch/en/High-pressure-valves/Fittings-1, 2018.
International Preliminary Report on Patentability issued in International Patent application PCT/US2019/033035 dated Nov. 24, 2020, 7 pages.
Office Action issued in U.S. Appl. No. 17/250,079 dated Dec. 20, 2021, 8 pages.
Extended Search Report issued in European Patent Application No. 19833515.0 dated Jan. 17, 2022, 7 pages.
Extended Search and Examination Report issued in European Patent Application No. 19808047.5 on Feb. 7, 2022, 7 pages.

FIXED CUTTER DRILL BIT WITH HIGH FLUID PRESSURES

RELATED PATENT APPLICATIONS

The present application is the U.S. national phase of International Patent Application No. PCT/US2019/040674, filed Jul. 5, 2019, and entitled "Fixed Cutter Drill Bit With High Fluid Pressures," which claims priority to and the benefit of U.S. Provisional Patent Application Ser. No. 62/694,972 entitled, "Fixed Cutter Drill Bit with High Fluid Pressures," and filed Jul. 7, 2018. This patent is related to U.S. Patent Application No. 62/674,512, filed May 21, 2018, which application is expressly incorporated herein by this reference in its entirety.

BACKGROUND

Downhole systems may be used to drill, service, or perform other operations on a wellbore in a surface location or a seabed for a variety of exploratory or extraction purposes. For example, a wellbore may be drilled to access valuable subterranean resources, such as liquid and gaseous hydrocarbons and solid minerals stored in subterranean formations, and to extract the resources from the formations.

Drilling systems are conventionally used to remove material from earth formations and other material, such as concrete, through primarily mechanical means. Fixed cutter bits, roller cone bits, reciprocating bits, and other mechanical bits fracture, pulverize, break, or otherwise remove material through the direct application of force. For different formations, different mechanical forces can be used to remove material. Changing the amount of mechanical force applied to the formation includes increasing or decreasing the torque or weight on bit on the drilling system, both of which introduce additional challenges to the drilling system.

Some mechanical bits include fluid conduits therethrough to direct drilling fluid to the cutting elements in order to flush cuttings and other debris from the cutting surfaces of the bit. Efficient removal of waste from the cutting area of the bit can reduce the torque and WOB used to remove material from the formation. Increasing the fluid pressure in a conventional bit erodes the bit and decreases the reliability and operational lifetime of the bit. A bit with one or more features that reduce the mechanical force to remove material from the formation without adversely affecting the reliability and lifetime of the bit is, therefore, desirable.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some embodiments, a device for removing material includes a low-pressure bit body that has a fixed cutting structure. A high-pressure bit body is coupled to, and radially within, the low-pressure bit body. At least one high-pressure nozzle is connected to the high-pressure bit body, and a high-pressure fluid conduit provides fluid communication through the high-pressure bit body to the at least one high-pressure nozzle. The high-pressure fluid conduit is configured to withstand fluid pressures of greater than 40 kpsi (276 MPa).

In some embodiments, a bottomhole assembly for removing material includes a drill bit and a pressure intensifier coupled to the drill bit. The drill bit has a bit body configured to rotate about a center axis, and includes a fixed cutter portion around a fluid jetting portion. A low-pressure fluid channel is in the bit body and exits the fixed cutter portion of the bit body. A high-pressure fluid channel is in the bit body and exits the fluid jetting portion of the bit body. At least one high-pressure nozzle is coupled to the fluid jetting portion of the bit body and is in fluid communication with the high-pressure fluid channel. A plurality of fixed cutting elements is coupled to the fixed cutter portion of the bit body. The pressure intensifier is configured to increase a pressure of a fluid and supply the fluid to the high-pressure fluid channel in the bit body.

According to some embodiments, a method of removing material from a formation includes flowing a fluid through a plurality of high-pressure nozzles in a drill bit at a fluid pressure greater than 40 kpsi (276 MPa). The fluid is directed at the formation in a plurality of fluid jets, and the formation is weakened with the fluid jets to create a weakened region that forms between 20% and 90% of a bottom of a wellbore. At least a portion of the weakened region is removed as cuttings, and the cuttings are flushed from the weakened region.

Additional features of embodiments of the disclosure will be set forth in the description which follows, and in part will be obvious from the description, or may be learned by the practice of such embodiments. The features of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. Drawings should be considered as being to scale, unless identified as a schematic, exaggerated, or other view; however, drawings shown to scale are merely illustrative, and other embodiments are contemplated that may have different dimensional relationships. Understanding that the drawings depict some example embodiments, the embodiments will be described and explained with additional specificity and detail through the use of the accompanying drawings in which:

FIG. 2-1 is a side partial cutaway view of a drilling bottomhole assembly (BHA) with a fixed cutter drill bit, according to an embodiment of the present disclosure;

FIG. 2-2 is a bottom view of the fixed cutter drill bit of FIG. 2-1;

FIG. 5-1 is a side partial cutaway view of a drilling BHA with a fixed cutter drill bit, according to another embodiment of the present disclosure;

FIG. 5-2 is a side view of the BHA of FIG. 5-1;

DETAILED DESCRIPTION

Embodiments of the present disclosure relate to downhole systems. More particularly, some embodiments of the present disclosure relate to drilling systems. Still further, example embodiments relate to drilling systems using a combination of relatively higher and lower fluid pressures through a drill bit, that is optionally a fixed cutter drill bit.

Embodiments disclosed herein relate to devices, systems, and methods for directing a high-pressure fluid jet through a drill bit. More particularly, embodiments of the present disclosure relate to drill bits having a reinforced, erosion-resistant portion of the drill bit to communicate a fluid therethrough at a pressure sufficient to remove material from an earth formation, thereby increasing a rate of penetration of the cutting bit, reducing the likelihood of a cutting element and/or a bit body failure, or combinations thereof. While a drill bit for cutting through an earth formation is described herein, it should be understood that the present disclosure is applicable to other cutting tools, such as milling bits, reamers, hole openers, and other drill bits, and through any suitable material, including formation, cement, concrete, metal, other materials, or combinations thereof.

Figure 1:
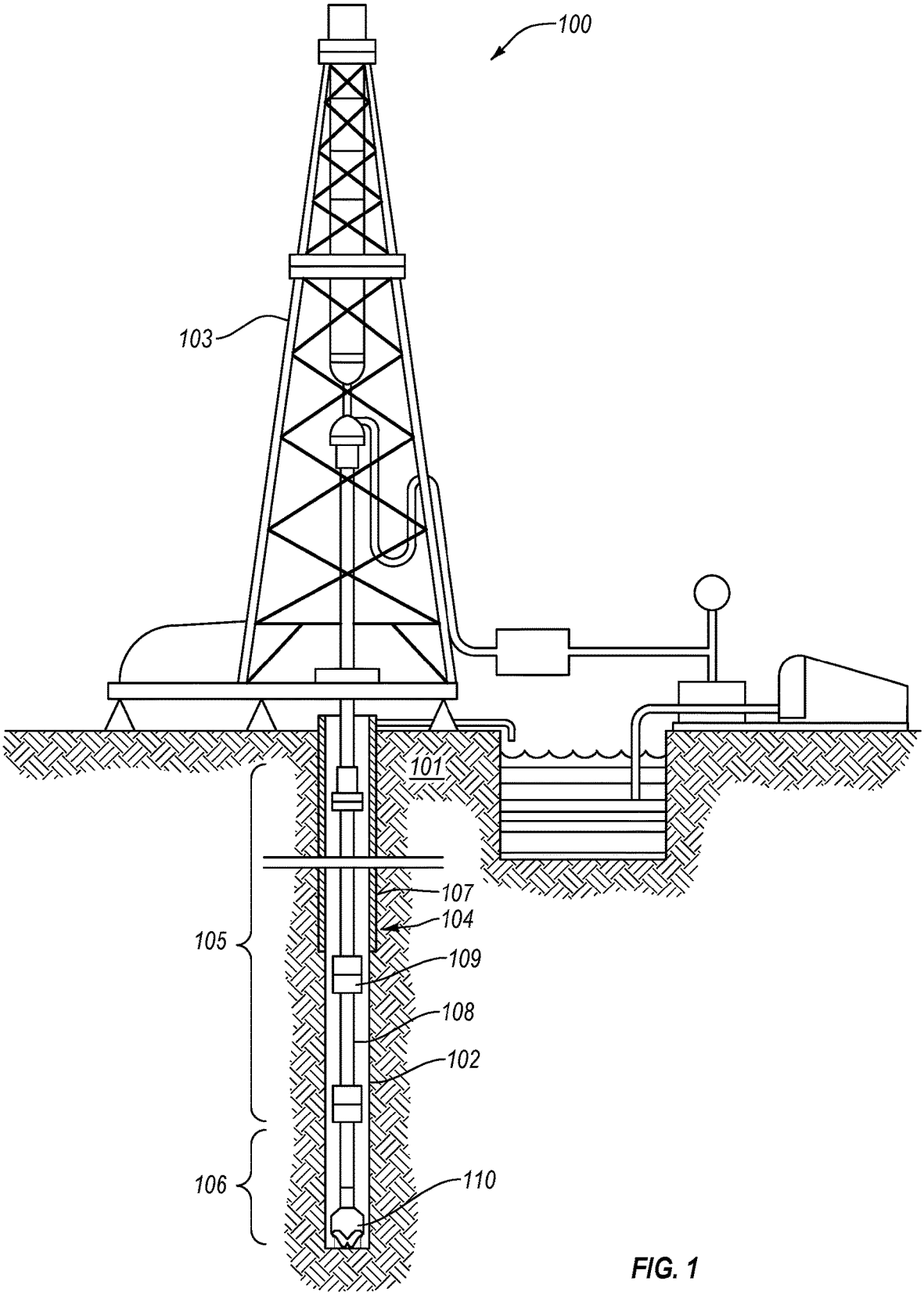
FIG. 1 is a schematic representation of a drilling system, according to an embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. In the illustrated embodiment, the drilling tool assembly 104 include a drill string 105 and a bottomhole assembly ("BHA") 106 at coupled to the downhole end of the drill string 105. A drill bit 110 is also included at the downhole end of the BHA 106.

The drill string 105 optionally includes several joints of drill pipe 108 a connected end-to-end through tool joints 109; however, in other embodiments the drill string 105 may include coil tubing. The drill string 105 transmits drilling fluid through a central bore and transmits rotational power from the drill rig 103 to the BHA 106, either directly as a torque (e.g., by using a rotary table and/or top drive), or indirectly as fluid flow (e.g., when the BHA 106 includes a downhole motor such as a positive displacement motor or turbine-powered motor). In some embodiments, the drill string 105 or the BHA 106 include additional components such as subs, pup joints, etc. The drill pipe 108 (and optionally other components of the drill string 105 or BHA 106) provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled. In embodiments of the present disclosure, the fluid jetted through the bit 110 is also responsible for drilling at least a portion of the wellbore 102.

The BHA 106 includes the bit 110, and optionally other components coupled between the bit 110 and at least a portion of the drill string 105. Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations or functions in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits (e.g., PDC bits, impregnated bits, coring bits), roller cone bits, and combinations thereof. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
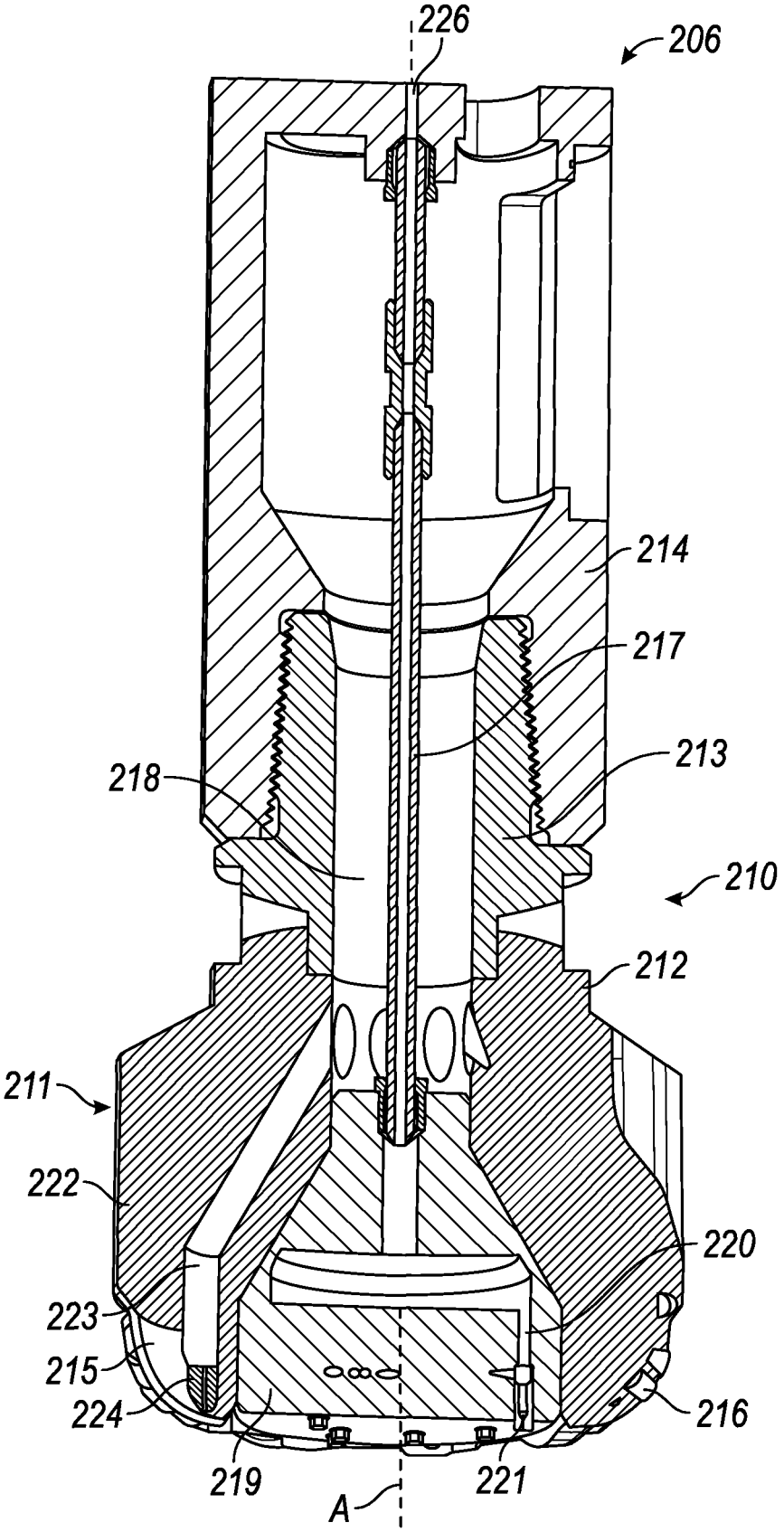
Figure 2:
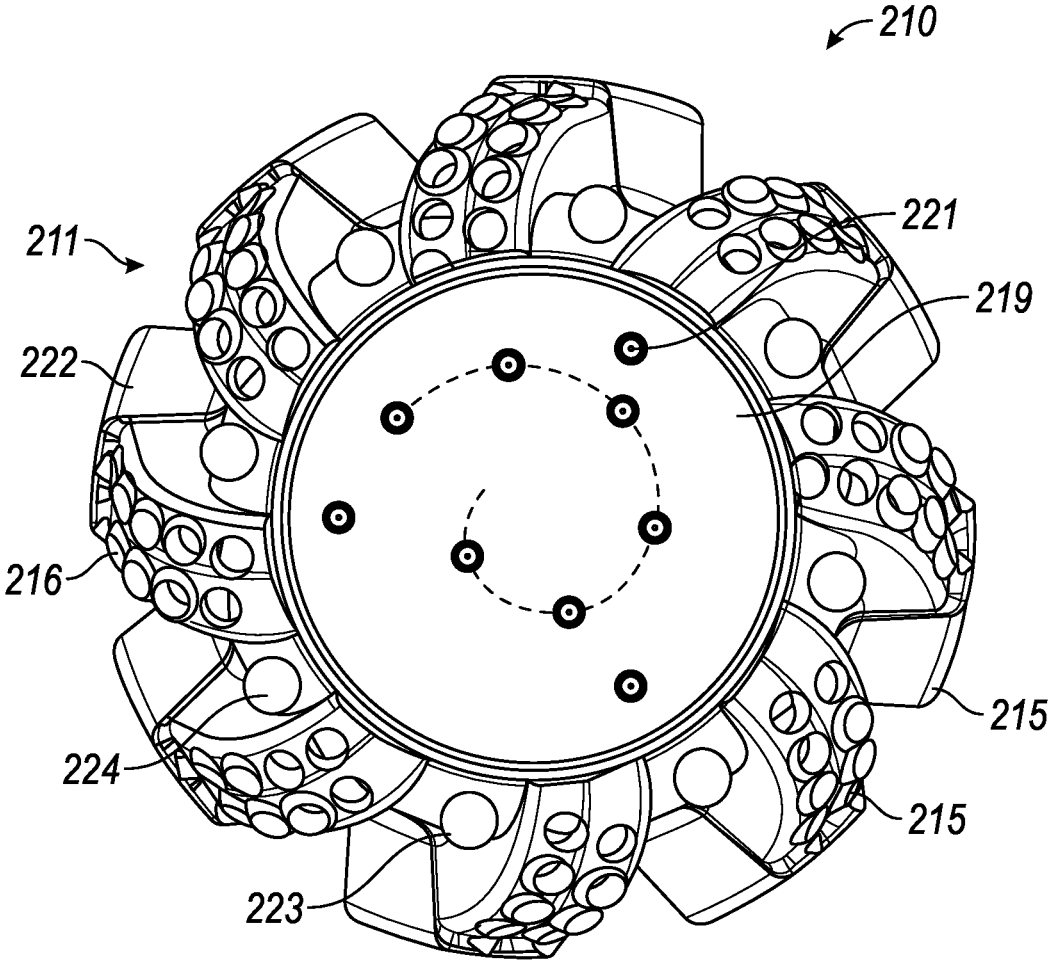

FIG. 2-1 illustrates an embodiment of a BHA 206 including a drill bit 210 having a high-pressure fluid conduit and a low-pressure fluid conduit in a bit body 211 thereof. The bit 210 generally includes a bit body 211, a shank 212, and a threaded connection or pin 213 for connecting the bit 210 to other BHA components (e.g., housing 214, a drill collar, a steering unit, a shaft of a downhole motor, etc.) or to a drill string (e.g., drill string 105 of FIG. 1), that is used to rotate the bit 210 around an axis A in order to drill the borehole.

The bit 210 is a fixed cutter bit having one or more blades 215, extending axially and radially from a face of the bit body 211. Each blade optionally includes one or more cutting elements (e.g., PDC cutting elements, impregnated diamond particles, etc.). In FIG. 2-1, for instance, the blade 215 includes a plurality of pockets 216 for receiving PDC cutting elements.

The bit 210 includes a high-pressure fluid conduit 217 and a low-pressure fluid conduit 218. In some embodiments, the high-pressure fluid conduit 217 carries fluid that flows to a high-pressure, highly erosion resistant body 219. The fluid in the high-pressure body 219 may flow through one or more high-pressure channels 220, and out one or more nozzles 221. Nozzles 221 direct the fluid at a high pressure toward a formation, casing, or other material to be cut and/or weakened by the fluid.

The low-pressure fluid conduit 218 carries fluid that flows to a low-pressure bit body 222. The fluid in the low-pressure body 222 may flow through one or more low-pressure channels 223, and out one or more low-pressure nozzles 224. Low-pressure nozzles 224 may direct fluid into a wellbore to flush debris away from the body 211, blades 215, and cutting elements in the pockets 216. The low-pressure nozzles 224 may take any suitable form. For instance, in some embodiments, the low-pressure nozzles 224 are conventional nozzles used with drill bits, while high-pressure nozzles 221 have relatively higher wear or erosion resistance. The number, angle, and location of the low-pressure nozzles 224 may also vary as desired to balance structural integrity of the low-pressure body 222 with enhanced hole cleaning, cooling of the cutting structure, and cuttings removal.

The fluid in the high-pressure fluid conduit 217 and the low-pressure fluid conduit 218 may be the same. In other embodiments, the fluid in the high-pressure fluid conduit 217 and the low-pressure fluid conduit 218 may be different fluids. For example, the low-pressure fluid conduit 218 may flow a drilling fluid (e.g., drilling mud) therethrough to flush debris from around the bit 210. The high-pressure fluid conduit 217 may experience higher rates of wear and/or erosion due at least to the higher fluid pressures compared to the low-pressure fluid conduit 218. The drilling fluid may contain particulates or contaminants in mixture and/or suspension that may damage the high-pressure fluid conduit 217. The high-pressure fluid conduit 217 may flow a fluid 219 that is free of particulates (or relatively more free of particulates), such as clean water, clean oil, or other liquid free of particulates. In other embodiments, the fluid in the high-pressure fluid conduit 217 includes additional particulates or contaminants that are not present in the fluid in the low-pressure fluid conduit 218.

In at least one embodiment, the high-pressure fluid conduit 217 may be in fluid communication with a high-pressure fluid pump located in the drill string (such as drill string 105 of FIG. 1), in the BHA 206, at the bit pin connection, at the surface, or combinations thereof. For instance, the housing 214 may be a pressure intensifier housing that increases fluid pressure within the high-pressure fluid conduit 218. In the illustrated embodiment, for instance, fluid may be directed into an internal nozzle that accelerates and increases the pressure of the fluid in the high-pressure fluid conduit 217, while allowing the fluid to pass through the low-pressure fluid conduit 218 without an equivalent acceleration and pressure intensification.

The high-pressure fluid conduit 217 may contain the fluid at a fluid pressure in a range having a lower value, an upper value, or lower and upper values including any of 40 kilopounds per square inch (kpsi) (276 megapascals (MPa)), 45 kpsi (310 MPa), 50 kpsi (345 MPa), 55 kpsi (379 MPa), 60 kpsi (414 MPa), 65 kpsi (448 MPa), 70 kpsi (483 MPa), 75 kpsi (517 MPa), 80 kpsi (552 MPa), or any values therebetween. For example, the high-pressure fluid conduit 217 may contain fluid at a fluid pressure in a range of 40 kpsi (276 MPa) to 80 kpsi (552 MPa). In another example, the HP fluid conduit 217 may contain fluid at a fluid pressure in a range of 50 kpsi (345 MPa) to 70 kpsi (483 MPa). In yet another example, the HP fluid conduit 217 may contain fluid at a fluid pressure of 60 kpsi (414 MPa). In at least one embodiment, the fluid pressure of the high-pressure fluid conduit 217 may be greater than 60 kpsi (414 MPa).

The high-pressure fluid conduit 217 may be cast, machined, molded, or otherwise formed in the high-pressure body 219. In some embodiments, the high-pressure body 219 and the low-pressure bit body 222 are made of or include different materials. For example, the high-pressure body 219 may be made of or include erosion resistant materials to withstand erosion by the movement of the fluid in the high-pressure fluid conduit 217 and the high-pressure channels 220. In another example, the high-pressure body 219 may be made of or include high strength alloys or materials to limit or prevent cracking of the high-pressure body when the fluid is pressurized over 40 kpsi (276 MPa), over 50 kpsi (345 MPa), over 60 kpsi (414 MPa), etc.

In some embodiments, the high-pressure body 219 is made of or includes high strength steel, low carbon steel, superalloys, Maraging (martensitic-aging) steel, tungsten carbide, PDC, or other erosion-resistant materials. The high-pressure body 219 may be cast, machined, or built by additive manufacturing such that the high-pressure channels 220 are integrally formed within the high-pressure body 219. For example, the high-pressure body 219 may be sand-cast with the high-pressure channels 220 formed in the high-pressure body 219. In another example, the high-pressure fluid channels 220 may be machined (e.g., bored) through a monolithic high-pressure body 219 to produce the high pressure fluid channels 220. In yet another example, additive manufacturing (such as selective laser melting, selective laser sintering, or electron beam melting) may build up the high-pressure body 219 one layer at a time while forming the high-pressure fluid channels 220 simultaneously.

The high-pressure body 219 may be heat treated and/or tempered after the additive manufacturing or other manufacturing. For example, the high-pressure body 219 may be solubilized and/or normalized to homogenize the microstructure (e.g., inducing partial and/or complete recrystallization or grain growth) to alter the mechanical properties from the as-melted or as-sintered material.

In some embodiments, the low-pressure bit body 222 is formed of a material suitable to allow relatively lower pressure fluid from the low-pressure conduit 218 and through the low-pressure channels 223 with suitable erosion resistance. In at least some embodiments, the low-pressure bit body 222 is formed of cast or machined steel, or is formed of a matrix material (e.g., tungsten carbide or steel powder with a metal binder). The pressure in the low-pressure fluid conduit 218 and the low-pressure channels 223 in the low-pressure bit body 222 may be significantly less than the pressure of the fluid in the high-pressure conduit 217 and the high-pressure channels 220. For instance, in at least some embodiments, the pressure of the fluid in the low-pressure conduit 218 or channels 223 is a fraction of the pressure of the fluid in the high-pressure conduit 217 or channels 220, with that fraction being within a range including a lower value, an upper value, or lower and upper values including any of 2%, 5%, 10%, 25%, 35%, 50%, or values therebetween. According to some embodiments, the high-pressure body 219 shows equivalent or improved erosion resistance as compared to the low-pressure body 222, despite the flow of the relatively higher pressure fluid therein.

The high-pressure body 219 and the low-pressure body 222 may be coupled together in any number of manners to form the bit body 211. In the illustrated embodiment, for instance, the high-pressure body 219 is surrounded by, and positioned within, the low-pressure body 222. Accordingly, the low-pressure body 222 may include an inner recess that is shaped to substantially complement the shape of the high-pressure body 219. Similarly, the high-pressure conduit 217 may be positioned within the low-pressure conduit 218. As illustrated, for instance, the high-pressure conduit 217 and low-pressure conduit 218 are substantially co-axial with longitudinal axis A, with the low-pressure conduit 218 surrounding the high-pressure conduit 217.

The illustrated arrangement of the high-pressure body 219, low-pressure body 222, high-pressure fluid conduit 217, and low-pressure fluid conduit 218 are merely illustrative. In other embodiments, for instance, the high-pressure body 219 may be at least partially outside the low-pressure body 222, or may completely surround the low-pressure body 222. Similarly, the low-pressure fluid conduit 218 may be positioned within the high-pressure fluid conduit 217. In other embodiments, the high-pressure fluid conduit 217 and the low-pressure fluid conduit 218 may be offset and not co-axial, with neither conduit housing the other. Additionally, although a single high-pressure body 219, a single high-pressure conduit 217, a single low-pressure body 222, and a single low-pressure fluid conduit 218 are illustrated, multiple of any or each of such components may be included in other embodiments.

The high and low-pressure bodies 219, 222 may be coupled together using any of a variety of connection methods. In some embodiments, the high-pressure body 219 is bonded to the low-pressure bit body 222 by, for example, welding, brazing, or other bonding of the materials of the high-pressure body 219 and the low-pressure body 222. In other embodiments, the high-pressure body 219 and the low-pressure body 222 may be joined by one or more mechanically interlocking features, such as a tongue-and-groove connection, a dovetail connection, a friction fit, a pinned connection, other mechanical interlocking features, or combinations thereof. For example, non-weldable materials, such as tungsten carbide may be joined by a sliding dovetail connection between the high-pressure body 219 and the low-pressure body 222, and the high-pressure body 219 and low-pressure body 222 may be fixed relative to one another by subsequent securing of the high-pressure body 219 and the low-pressure body 222 in the direction of the sliding dovetail (such as by welding a cap over the connection). In yet other embodiments, the high-pressure body 219 and the low-pressure body 222 may be joined with the use of one or more adhesives. In at least one embodiment, the high-pressure body 219 and the low-pressure body 222 may be joined by a combination of the foregoing, such as through welding of mechanically interlocking faces of the high-pressure body 219 and the low-pressure body 222. In some embodiments, one or more seals may be located between the interface between the high-pressure body 219 and the low-pressure body 222 to restrict and potentially prevent fluid flow from the low-pressure conduit 218 from escaping through the inner recess housing the high-pressure body 219.

FIG. 2-2 is a bottom view of the bit 210 of FIG. 2-1. The bit 210 depicted in FIG. 2-2 also includes a high-pressure body 219 within a low-pressure body 222. As further shown, the low-pressure body 222 may include a plurality of blades 215 that can contain one or more cutting elements (not shown, but may be located in pockets 216). In use, the one or more high-pressure nozzles 221 may be used to expel fluid at a high velocity, to act as a fluid jet that cuts the rock or other workpiece in an interior or center portion of the wellbore, while the cutting elements on the low-pressure body 222 may cut the rock or other workpiece at an outer portion of the wellbore. Accordingly, the low-pressure body 222 may define a fixed cutter portion of the bit body 211, while the high-pressure body 219 may define a fluid jetting portion of the bit body 211. In at least some embodiments, the fluid jetting portion is substantially free of active fixed cutting elements. As used herein, the phrase "substantially free of active fixed cutting elements" means that less than 20% of the area of the fluid jetting portion includes fixed cutting elements that are on the active cutting profile of the drill bit; however, in some embodiments, less than 15%, less than 10%, less than 5%, or less than 1% of the area of the fluid jetting portion may include fixed cutting elements that are on the active cutting profile of the drill bit.

The amount of material removed by jetting vs cutting elements may vary based on the structure of the bit 210, including the relative sizes of the high-pressure body 219 and the low-pressure body 222. In the illustrated embodiment, cutters on the low-pressure body 222 are largely at or near the gage of the bit 210 (and possibly on a portion of the shoulder), such that mechanical cutting/scraping of the wellbore is performed at or near the gage, while the cone, nose, and shoulder of the bit profile is formed by the high-pressure body 220, to form the interior portion of the wellbore using fluid jetting.

As will be appreciated in view of the disclosure herein, the drill bit 210 is used to form the bottom of the wellbore by using fluid jetting. For instance, the high-pressure body 219 may have a diameter that is between 15% and 95% of the gage diameter of the drill bit 210. In at least some embodiments, the nozzles 221 therefore provide fluid jetting to form the bottom of the wellbore, such that between 15% and 95% of the bottom of the wellbore is formed using fluid jetting, with the remainder formed by mechanical cutting/scraping of the low-pressure body 222 (e.g., cutting elements in the pockets 216). In a more particular, embodiment, the diameter of the high-pressure body 219 is within a range having a lower value, an upper value, or both lower and upper values that includes any of 15%, 20%, 25%, 30%, 40%, 50%, 60%, 75%, 85%, 90%, 95%, or any value therebetween, of the gage diameter of the low-pressure body 222 (and thus the drill bit 210).

To provide sufficient jetting to remove significant portions of the bottom of the wellbore, and to remove the cuttings formed by the drill bit 210, any number or arrangement of high-pressure nozzles (or jet nozzles) 221 and low-pressure nozzles 224 may be used. In at least one embodiment, a plurality of high-pressure nozzles 221 may be arranged in a spiral arrangement. In FIG. 2-2, for instance, a series of six jet nozzles 221 are arranged in a spiral pattern generally around the central axis of the high-pressure body 219 and the drill bit 210, while three jet nozzles 221 are arranged at the periphery, and near the outer diameter of the high-pressure body 219. This embodiment is merely illustrative, however, as any number of jet nozzles 221 and arrangement thereof may be used. For instance, each jet nozzle 221 may be arranged as part of a spiral arrangement, none (or more or fewer) jet nozzles 221 may be part of a spiral arrangement, concentric rings may be used, a checker-board arrangement may be used, a random arrangement may be used, or other arrangements of nozzles may be provided. Combinations of different arrangements may also be used (e.g., a central spiral arrangement with multiple concentric rings around the spiral, or angled rows extending from the spiral).

Additionally, the high pressure, jet nozzles 221 may have any suitable angle (in combination with different positions). In some embodiments, each jet nozzle 221 is oriented at a same angle relative to the axis of the drill bit 210; however, in other embodiments, one or more jet nozzles 221 are at different angles. By using different angles and positions, the jet nozzles 221 can form a fluid jetting area that covers a portion of the bottom of the wellbore as described herein. The fluid jetting area may extend radially outward to the portion of the wellbore bottom drilled by the fixed cutting structure of the low-pressure body 222, although in some embodiments, the entire wellbore bottom may be drilled using fluid jetting, with mechanical cutting occurring on only the gage of the drill bit 210. In some embodiments, there is an overlap between the portion of the wellbore drilled by fluid jetting and mechanical cutting. In at least some embodiments, the overlap is less than 20%, less than 10%, less than 5%, or less than 1% of the diameter of the drill bit 210.

Jet nozzles 221 may be integrally formed with the high-pressure body 219, or the jet nozzle 221 may be made of or include a same or different material from the high-pressure body 219 and may be connected to the high-pressure body 219 after manufacturing of the high-pressure body 219. For example, the jet nozzle 221 may include or be made of an ultrahard material with high abrasion and erosion resistance. As used herein, the term "ultrahard" is understood to refer to those materials known in the art to have a grain hardness of about 1,500 HV (Vickers hardness in kg/mm2) or greater. Such ultrahard materials can include but are not limited to diamond, sapphire, moissantite, polycrystalline diamond (PCD), leached metal catalyst PCD, non-metal catalyst PCD, hexagonal diamond (Lonsdaleite), cubic boron nitride (cBN), polycrystalline cBN (PcBN), binderless PCD or nanopolycrystalline diamond (NPD), Q-carbon, binderless PcBN, diamond-like carbon, boron suboxide, aluminum manganese boride, metal borides, boron carbon nitride, and other materials in the boron-nitrogen-carbon-oxygen system which have shown hardness values above 1,500 HV, as well as combinations of the above materials. In at least one embodiment, the nozzle 221 is a monolithic PCD. For example, the jet nozzle 219 may be formed of PCD and not include an attached substrate. In another example, the jet nozzle 219 includes an ultrahard coating on an inner diameter of a substrate. In some embodiments, the ultrahard material has a hardness value above 3,000 HV. In other embodiments, the ultrahard material has a hardness value above 4,000 HV. In yet other embodiments, the ultrahard material has a hardness value greater than 80 HRa (Rockwell hardness A).

Figure 3:
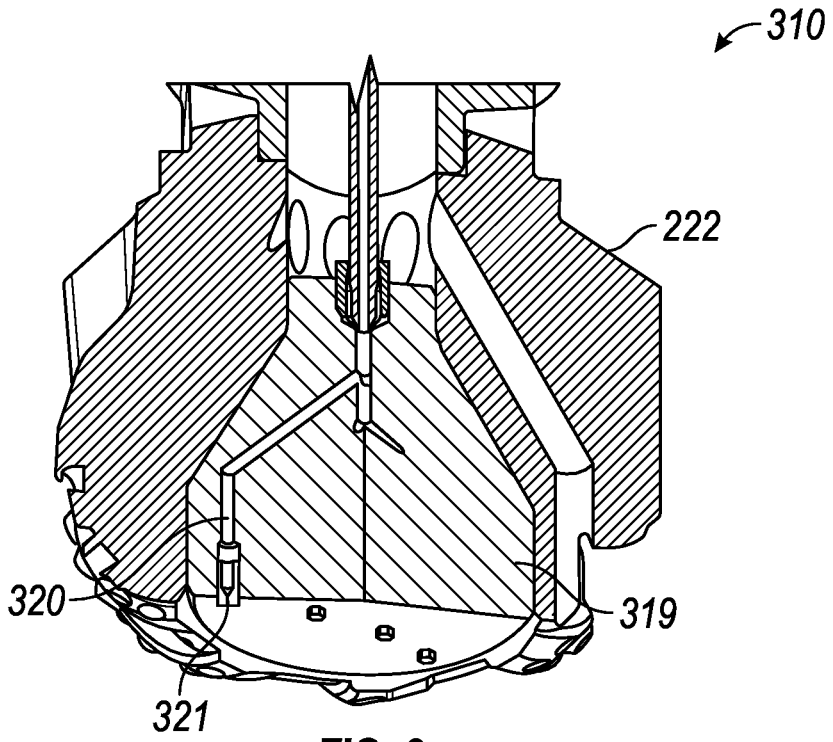
FIG. 3 is a side cross-sectional view of a fixed cutter drill bit, according to another embodiment of the present disclosure.

As discussed herein, a drill bit according to the present disclosure may have a number of different configurations. As shown in FIG. 3, for instance, a drill bit 310 includes a high-pressure body 319 within a low-pressure body 322. The high-pressure body 319 includes high-pressure channels 320 that lead to high-pressure, jet nozzles 321. In the illustrated embodiment, however, the fluid entering the high-pressure body 319 flows into a central channel that leads directly to the high-pressure channels 320. This is in contrast to the embodiment shown in FIG. 2-1, in which fluid entering the high-pressure body 219 flows into a plenum region before flowing into individual high-pressure channels 220.

Figure 4:
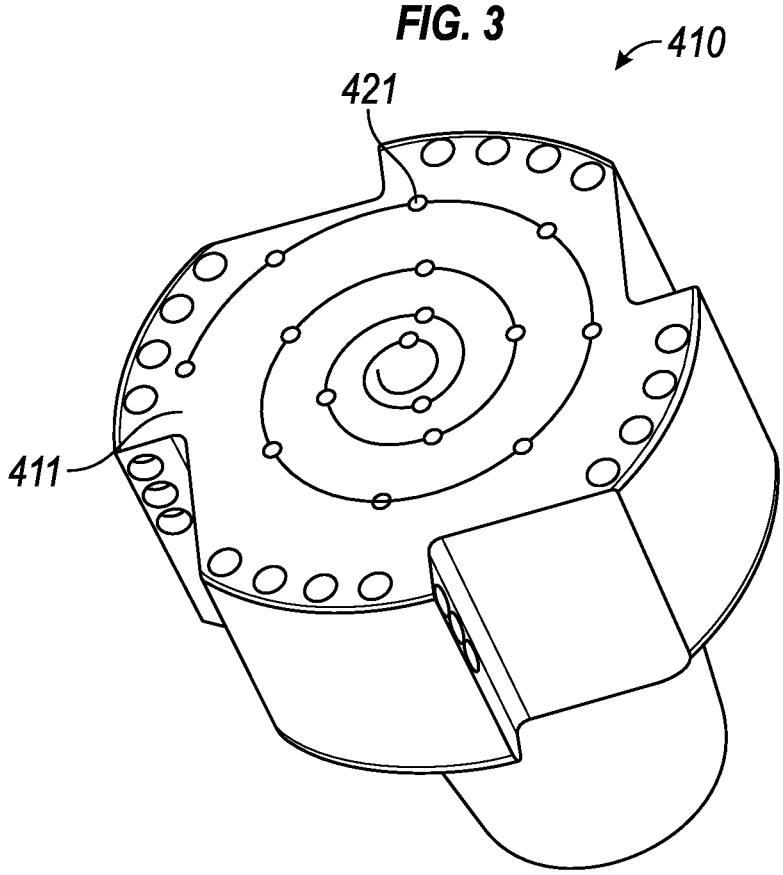
FIG. 4 is a perspective view of a fixed cutter drill bit, according to yet another embodiment of the present disclosure.

FIG. 4, in contrast, is a perspective view of another drill bit 410 that may be used for both mechanical cutting/scraping and fluid jetting to cut a bore in a rock formation or other workpiece. In the illustrated embodiment, the bit body 411 is unitary, with both the high-pressure channels and cutting structure formed in the same body 411.

Additionally, FIG. 4 illustrates n embodiment in which each of the fluid jets 421 are part of a same spiral arrangement. Moreover, the illustrated spiral arrangement includes four loops, with loops becoming increasingly farther apart as radial distance from the axis of the drill bit 410 increases. As will be appreciated in view of the disclosure herein, in the same or other embodiments, each loop may be separated from adjacent loops by a same distance, loops in the center may be farther apart, or more or few spiral loops may be included. Further, some high-pressure nozzles 421 may not be part of the spiral arrangement in other embodiments.

As discussed herein, in at least some embodiments, the fluid exiting high and low-pressure portions of drill bit may be the same, while in other embodiments, different fluids may be used. For instance, in at least some embodiments, by combining the fluid with abrasive particles, efficiency of the fluid jetting portion of a bit may be increased.

Figures 1, 5:
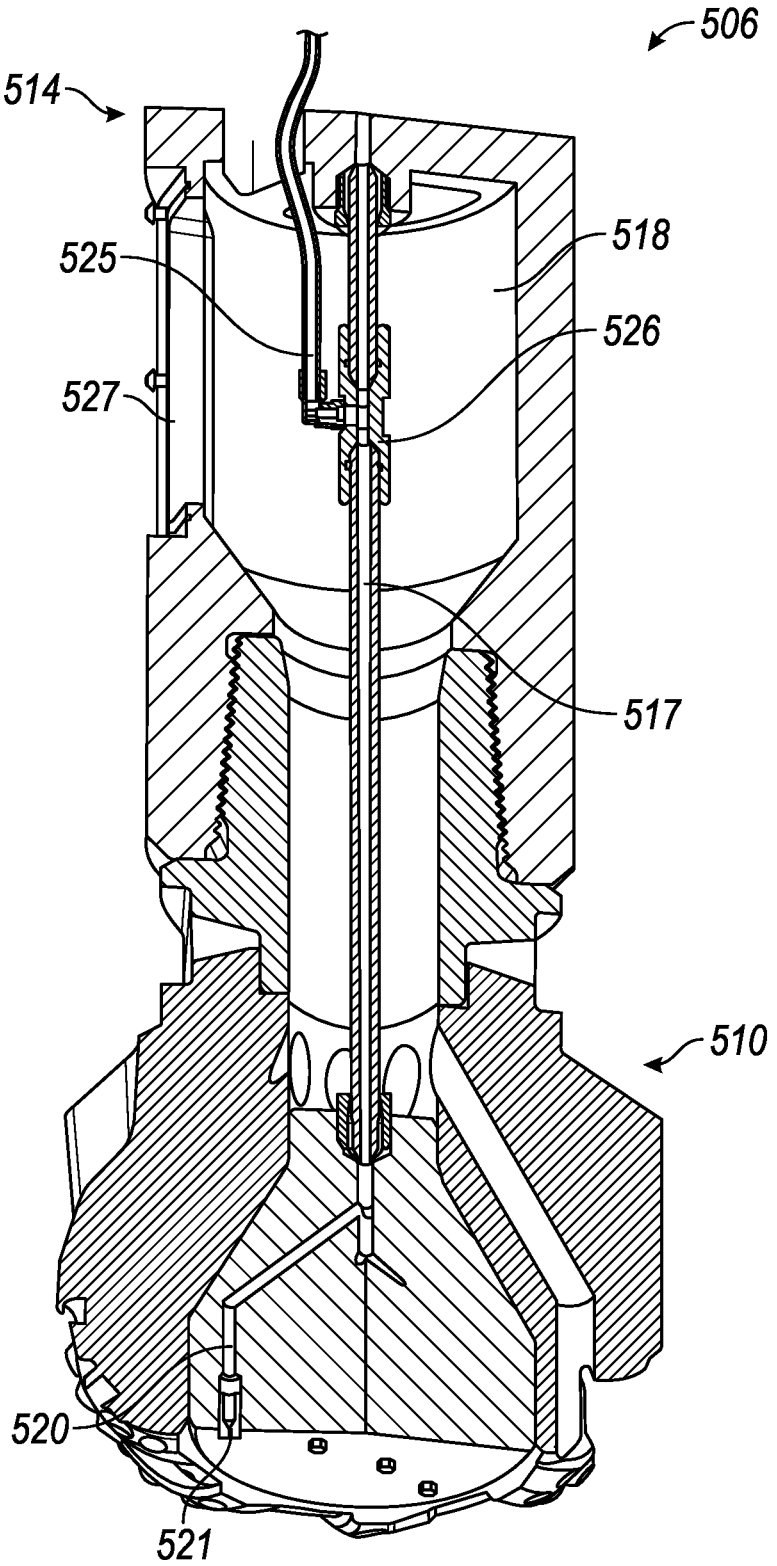
Figures 2, 5:
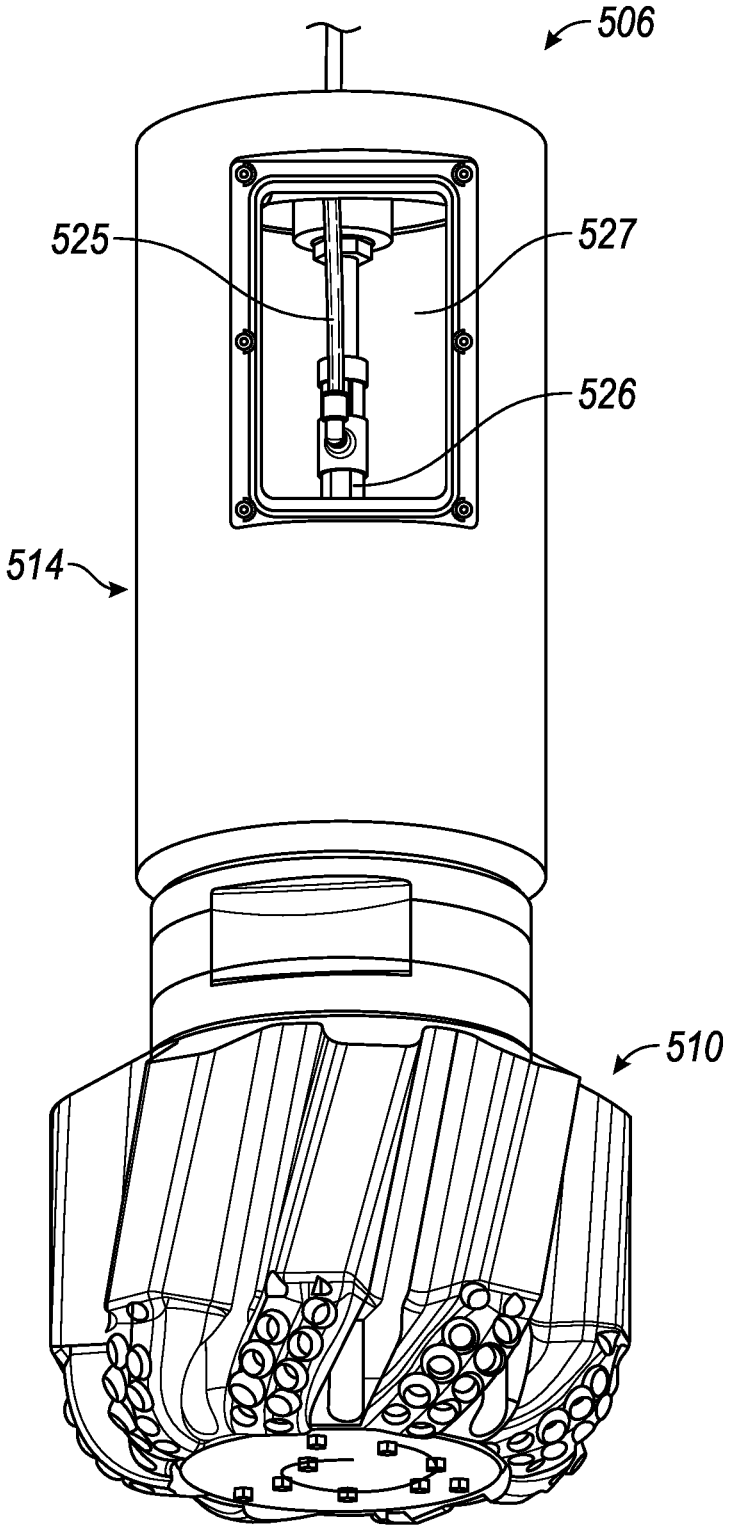

FIGS. 5-1 and 5-2 illustrate an example embodiment in which different fluids may be used by combining abrasive particles with the drilling fluid flowing to the high-pressure j et nozzles 521. In particular, a BHA 506 includes a drill bit 510 and a pressure intensifier 514 that is uphole of, and optionally coupled to, the drill bit 510. In some embodiments, the pressure intensifier 514 increases a pressure of fluid that flows through a high-pressure conduit 517 and into high-pressure channels 520 and high-pressure nozzles 521 of the drill bit 510. Coupled to the high-pressure conduit is a feeder 525. The feeder 525 may provide a supply of sand, solids, abrasives, or other materials that can be mixed with fluids entering the fluid conduit 517. The feeder 525 may connect directly to the high-pressure conduit 517, although in other embodiments the feeder 525 may be indirectly coupled to the high-pressure conduit 517. For instance, in FIG. 5-1, a mixer 526 is coupled to both the high-pressure conduit 517 and the feeder 525. The mixer 526 allows the fluid and the particles to enter the same conduit, and mix before being supplied to the drill bit 510.

The mixer 526 may be supplied at any suitable location. In the illustrated embodiment, the mixer 526 is positioned in the body of the pressure intensifier 514; however, the mixer 526 may be at other locations (e.g., in the bit 510 (see FIG. 6), in a drill collar, etc.). In some embodiments, the mixer 526 is located nearer the bit 510 to reduce wear/erosion. In particular, as mixing the fluid and particles may create a more abrasive slurry or mixture, moving the mixer 526 near the bit 510 allows a shorter portion of the high-pressure conduit 517 to be exposed to the more abrasive fluid. Thus, in embodiments where a coating, material selection, or other feature is chosen to reduce erosion in the high-pressure conduit 517, the coating, erosion-resistant material, and the like may be used over a shorter distance.

Optionally, the feeder 525 and/or mixer 526 may be inspected, installed, or accessed through the housing of the pressure intensifier 514 or another component in which the feeder 525 and/or mixer 526 are positioned. FIG. 5-2, for instance, illustrates a window 527 formed in the body of the pressure intensifier 514. The window 527 may include a removable inspection/access panel and seals. When the panel and seals are in place, fluid flow out of the low-pressure conduit 518, and through the window 527 may be restricted or even prevented. When the panel is removed, the mixer 526 and/or feeder 525 may be accessed for inspection, repair, or installation.

Figure 6:
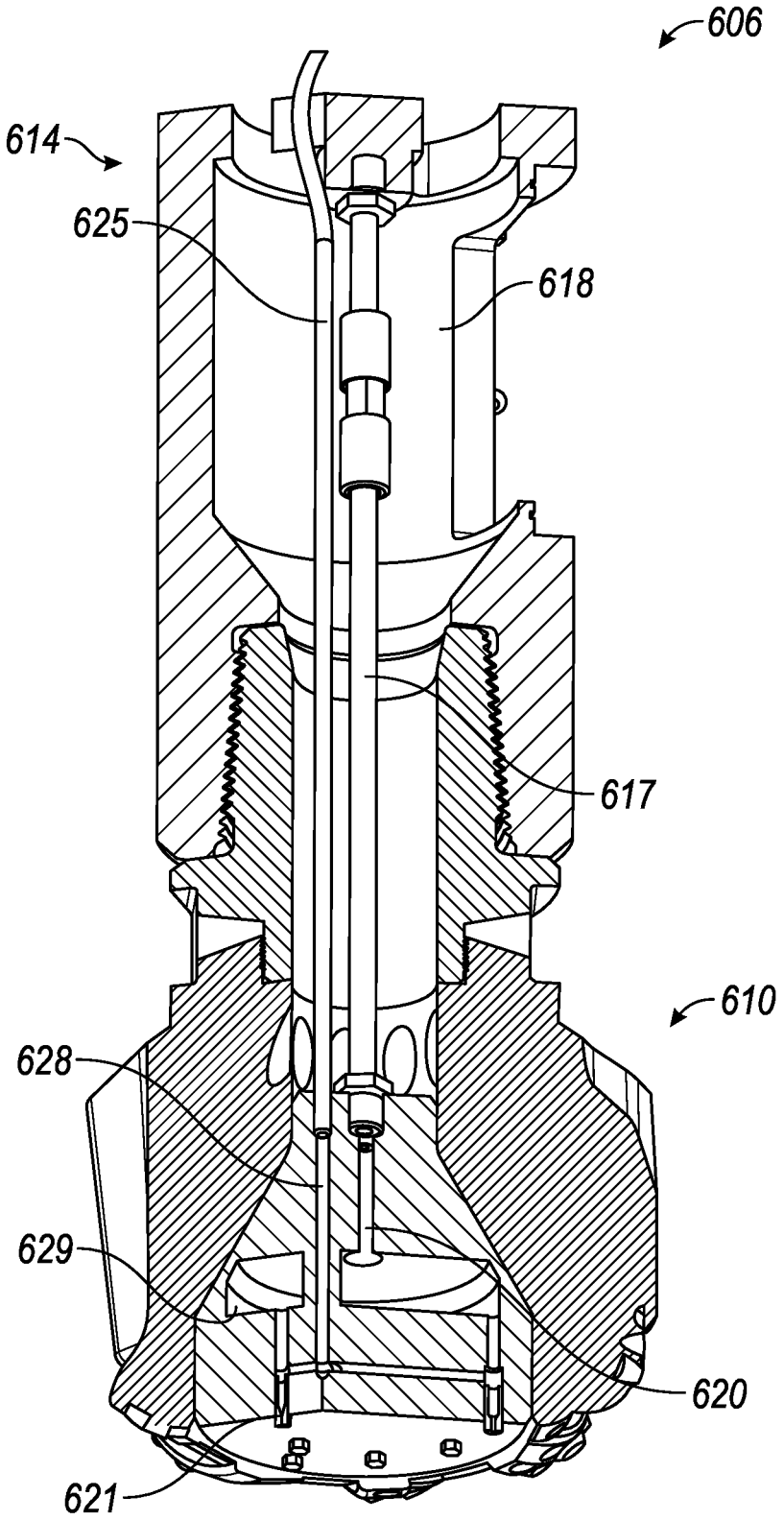
FIG. 6 is a side partial cutaway view of a drilling BHA with a fixed cutter drill bit, according to another embodiment of the present disclosure.

Turning to FIG. 6, another example embodiment of a BHA 606 is shown, with the BHA including a pressure intensifier 614 that increases fluid pressure of a fluid and provides it to a drill bit 610 through a high-pressure conduit 617. As also shown, low-pressure fluid may also be provided to the drill bit 610 through a low-pressure conduit 618 in the pressure intensifier 614 and/or drill bit 610.

The illustrated BHA 606 may also be used to add particles to fluid in the high-pressure conduit 617, so that a more abrasive fluid may be jetted from the high-pressure jets 621 in the drill bit 610, for more efficient removal of formation or other workpiece materials. In this embodiment, the BHA 606 includes a feeder 625 to provide the abrasive particles or other materials, and the feeder 625 provides the materials directly into the drill bit 610. In particular, the drill bit includes high-pressure channels 620 that receive fluid from the high-pressure conduit 617, and feeder channels 628 that receives particles from the feeder 625. The high-pressure channels 620 intersect with one or more feeder channels 628, that are optionally located near the high-pressure nozzles 621. This allows the abrasive or other materials to be combined with the high-pressure fluid either at the high-pressure nozzles 621, or just before the fluid enters the high-pressure nozzles 621. In some embodiments, rather than using the feeder 625, abrasive particles may be stored in a reservoir 629 in the drill bit 610.

Where the feeder 625 is provided, the sand, abrasives, solids, particles, or other materials provided by the feeder 625 may be stored in any suitable location. For instance, the materials may be stored downhole in the pressure intensifier 614, or in some other portion of the BHA 606. In such embodiments, the feeder 625 may extend through, be connected to, or otherwise cooperate with the pressure intensifier 614. In still other embodiments, the abrasive or other materials may be provided from the rig floor. In still other embodiments, the abrasive particles can be contained in drilling mud and filtered out of the mud by the BHA, and then mixed back into the high-pressure fluid in the high-pressure conduit 617 or channels 620.

Any suitable fluid may also be used. For instance, as discussed herein, drilling mud may be used as the fluid for a low or high-pressure conduit. In some embodiments, water may be used and mixed with abrasives in high-pressure conduits or channels, used alone in high-pressure conduits or channels, or used in low-pressure channels and conduits. For instance, pure high-pressure water jettying may also be useful in some wellbore conditions (e.g., high hydrostatic pressure, complex flow conditions, etc.), and can cut the rock surface with high-pressure water jets to increase removed rock volume and drill bit efficiency. As discussed herein, this may be coupled with use of mechanical cutters in addition to the fluid jetting, although in some embodiments little or no mechanical rock removal is done on the wellbore bottom by cutters.

Figure 7:
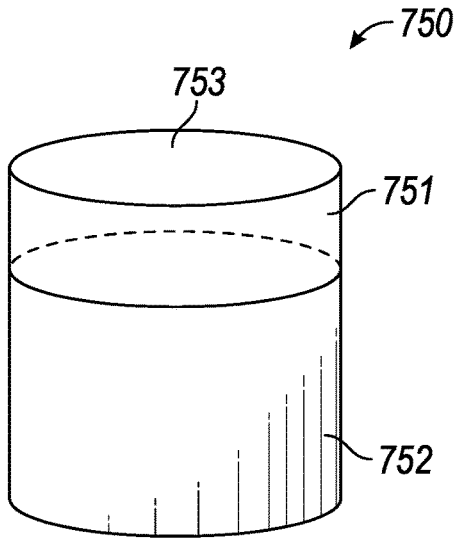
FIGS. 7-10 are side views of cutting elements, according to embodiments of the present disclosure.

Certain embodiments of the present disclosure relate to drill bits with cutting elements used in combination with fluid jets, so that cutting of formation to form the bottom of a wellbore includes fluid jetting and optionally mechanical cutting. In some embodiments, however, mechanical cutters are located at only the gage of the drill bit. Any suitable cutting element or structure may be used. Where fixed cutter drill bits are used, fixed cutters may have any suitable size, shape, material composition, or the like. In at least some embodiments, the fixed cutters are planar, shear cutting elements such as that shown in FIG. 7, in which a cutting element 750 includes a diamond table 751 coupled to a substrate 752. The diamond table 751 includes a flat or planar cutting face 753 used to shear the formation. In at least some embodiments, the cutting element 750 may be coupled to the drill bit in a manner that allows the cutting element 750 to rotate on its axis while being fixed to the drill bit.

Figure 8:
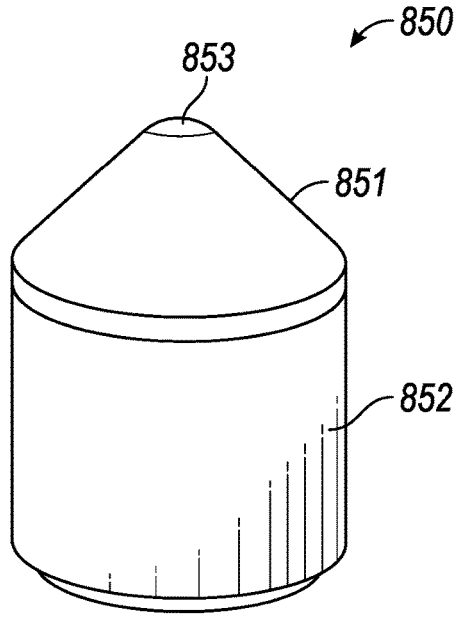
Figure 9:
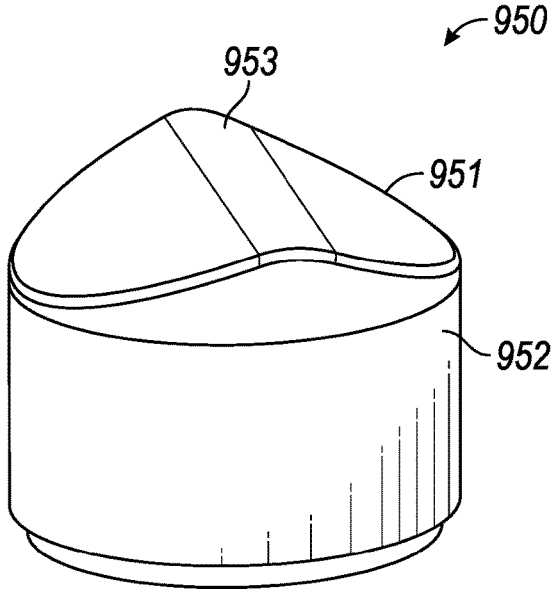
Figure 10:
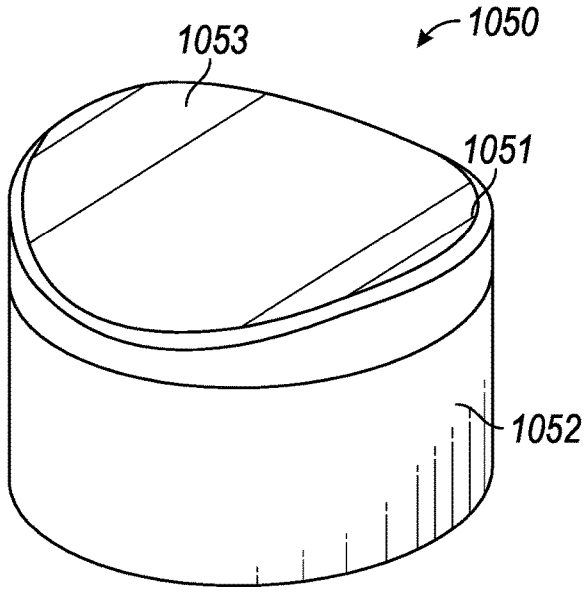

Other examples of non-planar cutting elements that are suitable for use with embodiments of the present disclosure are shown in FIGS. 8-10. In particular, FIGS. 8 and 9 show pointed cutting elements 850, 950. Specifically, FIG. 8 illustrates a pointed cutting element 850 having a diamond table 851 coupled to a substrate 852, where the diamond table forms a generally conical cutting face 853. In this particular example, the apex of the conical cutting face 853 has a radius of curvature, although in other embodiments, the apex may be flat or have a sufficiently small radius of curvature that it appears pointed. Cutting element 950 of FIG. 9 likewise includes a diamond table 951 coupled to a substrate 952; however, the pointed cutting face 953 has a ridge formed thereon. The ridge also has a radius of curvature, but could be sharp or flat in other embodiments. In at least some embodiments, the ridge may extend across a full diameter of the cutting element, although in other embodiments, the ridge may extend less than a full diameter of the cutting element. For instance, three, four, or more ridges may be formed on the cutting face and extend toward the center of the diamond table 951.

FIG. 10 illustrates a non-planar cutting element 1050 having a concave cutting face 1053 formed in the diamond table 1051 that is attached to a substrate 1052. The cutting face 1053 may include one or more depressions that create a concave structure. In at least some embodiments, the concave cutting face 1053 can be used to provide an effective positive back rake angle at the contact with the formation, even when the axis of the cutting element is positioned at a negative back rake angle.

It should be appreciated in view of the disclosure herein, that the described and illustrated embodiments are illustrative only, and are not intended to be an exhaustive list of all possible features or aspects that are within the scope of the present disclosure. Additionally, although certain features are described with respect to different embodiments, it is contemplated that any features may be used in combination, except where such features are by their nature mutually exclusive. Accordingly, although the cutting structure of FIG. 2-2 is described in connection with the pressure intensifier of FIG. 2-1, that lacks a mixer or feeder, such cutting structure could also be used in connection with pressure intensifiers having a mixer, feeder, or access window. Likewise, the pressure intensifier of FIG. 2-1 could be used in connection with the cutting structure of FIG. 3 or FIG. 4.

Additionally, in addition to rigid connections between components (e.g., high-pressure conduits and a feeder, mixer, or pressure intensifier), sliding or flexible connectors, or swivels or axial compensation may also be used to facilitate high-pressure connections.

While embodiments of bits and fluid conduits have been primarily described with reference to wellbore drilling operations, the bits and fluid conduits described herein may be used in applications other than the drilling of a wellbore. In other embodiments, bits and fluid conduits according to the present disclosure may be used outside a wellbore or other downhole environment used for the exploration or production of natural resources. For instance, bits and fluid conduits of the present disclosure may be used in a borehole used for placement of utility lines. In other examples, bits and fluid conduits of the present disclosure may be used in wireline applications and/or maintenance applications. Accordingly, the terms "wellbore," "borehole," and the like should not be interpreted to limit tools, systems, assemblies, or methods of the present disclosure to any particular industry, field, or environment.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. It should be understood that any directions or reference frames in the preceding description are merely relative directions or movements. For example, any references to "up" and "down" or "above" and "below" are merely descriptive of the relative position or movement of the related elements. Any element described in relation to an embodiment or a figure herein may be combinable with any element of any other embodiment or figure described herein.

Any element described in relation to an embodiment or a figure herein may be combinable with any element of any other embodiment or figure described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A device for removing material, the device comprising:

a low-pressure bit body including a fixed cutting structure and a recess;

a high-pressure bit body coupled to, and radially within, the recess of the low-pressure bit body, wherein the high-pressure bit body comprises a complementary shape to the recess;

at least one high-pressure nozzle connected to the high-pressure bit body; and a high-pressure fluid conduit providing fluid communication through the high-pressure bit body to the at least one high-pressure nozzle, the high-pressure fluid conduit being configured to withstand fluid pressures of greater than 40 kpsi (276 MPa).

2. The device of claim 1, the low-pressure bit body and the high-pressure bit body forming a bottom of the device, wherein an axis of the device extends through the high-pressure bit body within the recess of the low-pressure bit body at the bottom of the device.

3. The device of claim 1, the high-pressure bit body further including a plurality of high-pressure channels.

4. The device of claim 3, the at least one high-pressure nozzle including a plurality of high-pressure nozzles in fluid communication with the plurality of high-pressure channels.

5. The device of claim 4, the plurality of high-pressure nozzles having a spiral arrangement.

6. The device of claim 1, further comprising:

at least one low-pressure nozzle connected to the low-pressure bit body.

7. The device of claim 1, further comprising a low-pressure fluid conduit providing fluid communication through the low-pressure bit body.

8. The device of claim 7, the high-pressure fluid conduit being within the low-pressure fluid conduit and fluidly isolated therefrom.

9. The device of claim 1, a diameter of the high-pressure bit body being between 20% and 90% of a diameter of the low-pressure bit body.

10. A bottomhole assembly for removing material, comprising:

a drill bit having:

a bit body having a center axis, the bit body configured to rotate about the center axis, the bit body including a fixed cutter portion around a fluid jetting portion;

a low-pressure fluid channel in the bit body and exiting the bit body in the fixed cutter portion;

a high-pressure fluid channel in the bit body and exiting the bit body in the fluid jetting portion;

at least one high-pressure nozzle coupled to the fluid jetting portion of the bit body and in fluid communication with the high-pressure fluid channel; and a plurality of fixed cutting elements coupled to the fixed cutter portion of the bit body, wherein less than 20% of the area of the fluid jetting portion includes active fixed cutting elements; and a pressure intensifier coupled to the drill bit, the pressure intensifier configured to increase a pressure of a fluid and supply the fluid to the high-pressure fluid channel in the bit body.

11. The bottomhole assembly of claim 10, wherein less than 10% of the area of the fluid jetting portion includes active fixed cutting elements.

12. The bottomhole assembly of claim 10, further comprising a high-pressure fluid conduit coupling the pressure intensifier to the high-pressure fluid channel, and a low-pressure fluid conduit coupling the pressure intensifier to the low-pressure fluid channel.

13. The bottomhole assembly of claim 10, the pressure intensifier including an abrasive particle feeder coupled to a high-pressure fluid conduit in communication with the high-pressure fluid channel.

14. The bottomhole assembly of claim 10, the drill bit including an abrasive particle reservoir in communication with the high-pressure fluid channel.

15. A method of removing material from a formation, the method comprising:

flowing a fluid through a plurality of high-pressure nozzles in a drill bit at a fluid pressure greater than 40 kpsi (276 MPa);

directing the fluid at the formation in a plurality of fluid jets;

weakening the formation with the plurality of fluid jets to create a weakened region forming between 20% and 90% of a bottom of a wellbore;

removing at least a portion of the weakened region as cuttings;

mechanically cutting the formation with a plurality of active fixed cutting elements, substantially all of the plurality of active fixed cutting elements being positioned radially outside the fluid jets; and flushing the cuttings from the weakened region.

16. The method of claim 15, the plurality of fixed cutting elements being located substantially in shoulder and gage regions of the drill bit.

17. The method of claim 15, the plurality of fixed cutting elements defining a fixed cutter region of the wellbore having less than 15% overlap with a fluid jetting region of the wellbore.

18. The method of claim 15, wherein the fluid is clean water.

19. The method of claim 15, wherein flushing the cuttings from the weakened region includes flushing the cuttings at least partially with a drilling fluid provided through a low-pressure channel in the drill bit.

20. The method of claim 15, wherein the plurality of high-pressure nozzles are arranged in a spiral arrangement.

* * * * *